US006648747B1

(12) United States Patent
Zimmermann

(10) Patent No.: US 6,648,747 B1
(45) Date of Patent: Nov. 18, 2003

(54) DEVICE FOR SORTING COINS

(75) Inventor: Thomas Zimmermann, Berlin (DE)

(73) Assignee: F. Zimmermann GmbH & Co. KG (DE)

( * ) Notice: Subject to any disclaimer, the term of this patent is extended or adjusted under 35 U.S.C. 154(b) by 161 days.

(21) Appl. No.: 09/722,134

(22) Filed: Nov. 24, 2000

(30) Foreign Application Priority Data

Nov. 23, 1999 (DE) ..... 199 57 483

(51) Int. Cl.[7] ..... G07D 3/02
(52) U.S. Cl. ..... 453/9; 453/7
(58) Field of Search ..... 453/4, 7, 9, 11

(56) References Cited

U.S. PATENT DOCUMENTS 3,242,931 A * 3/1966 Wandrey ..... 453/29
3,590,833 A * 7/1971 Walton ..... 453/9
4,586,522 A * 5/1986 Taipale et al. ..... 453/10
4,681,204 A 7/1987 Zimmermann
4,995,848 A * 2/1991 Goh ..... 453/9 X
5,902,178 A * 5/1999 Perkitny ..... 453/9
RE36,966 E * 11/2000 Perkitny ..... 453/9

FOREIGN PATENT DOCUMENTS

| | | |
|---|---|---|
| DE | 195 20 005 | 8/1996 |
| EP | 1 103 929 | 5/2001 |
| WO | WO 99/48057 | 9/1999 |

* cited by examiner

*Primary Examiner*—Christopher P. Ellis
*Assistant Examiner*—Thuy V. Tran
(74) *Attorney, Agent, or Firm*—McGlew and Tuttle, P.C.

(57) ABSTRACT

A device for sorting coins of a set of coins with a coin feed device 1, with a coin sorting plate 2 joining the coin feed device 1, which has a guide edge 3, a guide strip 4 extending along the guide edge 3 as well as a series of sorting openings 5 graduated for different coin diameters with cross sections increasing in the direction of conveying. The sorting plate 2 is designed as an interchangeable sorting plate 2.

15 Claims, 5 Drawing Sheets

DEVICE FOR SORTING COINS

FIELD OF THE INVENTION

The present invention pertains to a device for sorting coins of a set of coins with a coin feed device, with a sorting plate joining the coin feed device, having a guide edge, a guide strip extending along the guide edge as well as a series of sorting openings graduated for different coin diameters with cross sections increasing in the direction of conveying, a set of sorting plates for such a device, as well as to a process for converting such a device to different sets of coins.

BACKGROUND OF THE INVENTION

Coins are defined within the framework of the present invention as disk-shaped, mostly round objects which represent a monetary value. Thus, besides legal means of tender, the term coins also covers value chips, tokens, coin blanks, round blanks for coins, etc. A device for conveying coins on the sorting plate, e.g., a conveyor belt, is typically set up. The coins are conveyed between the conveyor belt and the sorting plate. The conveyor belt, including its guide elements, may be introduced detachably or pivotably, so that access to the sorting plate is possible. When a coin is being conveyed on a sorting plate, it moves along the guide edge. Each coin moving on the sorting plate is continuously supported by the guide strip. The sorting openings have different opening cross sections with increasing opening cross section q measured at right angles to the direction of conveying. A coin whose diameter is smaller than the sum of the cross sections q and the width d of the guide strip is supported only on the (comparatively very narrow) guide strip (whose width is, e.g., 0.05 to 0.4 times q) on one side and it consequently falls through the sorting opening. The sorting openings of a sorting plate are graduated with increasing opening cross sections in the direction of conveying. As a result, sorting of all coins of the set of coins is achieved. A means for counting the unsorted or sorted coins may be additionally provided within the framework of such a device. Furthermore, a device for sorting out counterfeit coins may be provided between the coin feed device, typically a rotary table, and the sorting plate. Reference is made in this connection only, e.g., to the literature reference EP 0 189 429 B1 which corresponds to U.S. Pat. No. # 4,681,204.

Devices of the design described in the introduction have been known from, e.g., the literature reference DE 196 33 518 C1. The drawback of the devices known in this respect is that the device is delivered for a certain set of coins and a conversion of the device to another set of coins is possible with very great installation and adjustment efforts only. This is disturbing especially in cases of a changeover to another currency, e.g., the changeover from European national currencies to the euro.

SUMMARY AND OBJECTS OF THE INVENTION

Therefore, compared with the state of the art, the basic technical object of the present invention is to propose a device for sorting coins which can be converted to another set of coins simply and with little effort.

To accomplish this technical object, the present invention teaches that the sorting plate is designed as an interchangeable sorting plate. A sorting plate that can be removed and mounted with simple means, preferably without any tool, is called an interchangeable sorting plate. It is achieved with the present invention that, e.g., the changeover from European national currencies to the euro can be carried out without an appreciable installation effort and consequently without an appreciable loss of time. Moreover, it is possible to change back from one set of coins to the other one and back again to the first one in an extremely short time during a transition period. Finally, the present invention makes possible the very simple and inexpensive replacement of used sorting plates.

A preferred embodiment of the present invention is characterized in that the interchangeable sorting plate has at least one adjusting surface, wherein the interchangeable sorting plate can be inserted in the course of its insertion into the device by means of an adjusting element which interacts with the adjusting surface and is a rigid part of the machine. This embodiment of the present invention has a number of advantages concerning the problem of the accurate adjustment of the interchangeable sorting plate. On the one hand, the use of fits with narrow tolerances, which could lead to complications during installation, e.g., due to canting, etc., is avoided. On the other hand, the need for first adjusting and fixing an interchangeable sorting plate that may have been inserted loosely before putting the device into operation is eliminated.

The interchangeable sorting plate preferably has at least one fixing element, e.g., a thumbscrew, for fixing the interchangeable sorting plate inserted on a carrier plate. Any other fixing connections which can be easily handled manually, e.g., snap-in connections or quick-acting closures, are, of course, also possible instead of a thumbscrew.

The present invention may be specifically designed such that the adjusting surface is bent at an angle in relation to the longitudinal extension of the interchangeable sorting plate. It is achieved as a result that in the course of the insertion of the interchangeable sorting plate, the interchangeable sorting plate is brought automatically into the desired position by the interaction between the adjusting surface and the adjusting element. Correspondingly, the orientation of the adjusting surface shall be selected according to the desired end position. It is recommended for this that the end of the adjusting surface have a partial rest surface when viewed in the direction of installation. The accurate positioning is then carried out in practice in the simplest case such that an operator pushes in the interchangeable sorting plate and the adjusting surface is pushed, suitably guided manually, along the adjusting element into the end position of the interchangeable sorting plate. Additional adjusting surfaces may be arranged in parallel or in opposite directions (mirror symmetrically to a plane extending at right angles to the longitudinal extension of the interchangeable sorting plate) along the longitudinal extension of the interchangeable sorting plate. A pair of adjusting surfaces relieves an operator of the need to push along an adjusting surface against the adjusting element. The movement into the desired end position takes place automatically. The adjusting surface may be arranged in a closed recess of the interchangeable sorting plate or in a recess of the interchangeable sorting plate that is open (e.g., on one side). The adjusting element, which is a rigid part of the machine, may now be designed as a pin engaging the recess. It is recommended in this case to provide a "clearance" in the area of the end position or partial rest surface to avoid problems because of abraded particles or other contaminants, which may become deposited in the recess. "Clearance" means that the free cross section within the recess is larger in all areas than the cross section of the adjusting element and thus it permits the adjusting surface or the partial rest surface to move off from the adjusting element in all positions of the interchangeable sorting plate. In the case of two recesses with adjusting surfaces which are arranged in each recess on one side and extend in opposite directions, accurate positioning can be achieved even despite the provision of "clearance" in every individual recess without the need for a special manual guiding during the installation. Only the adjusting elements are to be inserted at spaced locations such that moving off of the adjusting elements from the adjusting surfaces or partial rest surfaces is no longer possible in the inserted state.

An especially simple fixation of the interchangeable sorting plate on the carrier plate, which can be carried out especially rapidly, is achieved if at least one laterally projecting holding strap, which can be introduced into a holding recess that is a rigid part of the machine, is provided at an edge of the interchangeable sorting plate which edge extends in the longitudinal extension (long side). The holding strap in the holding recess may be able to be pressed against the carrier plate in a non-positive manner, e.g., by means of a retaining spring. The holding strap and the fixing element may be arranged opposite one another directly or with an offset relative to the transverse extension of the interchangeable sorting plate. The holding strap points in the direction of installation of the interchangeable sorting plate.

It is also possible to provide at least one stop element, which is a rigid part of the machine and with which the interchangeable sorting plate comes into contact in the direction of installation or at right angles to the longitudinal extension of the interchangeable sorting plate in the course of the insertion with the long side.

It is obvious that a plurality of adjusting surfaces, holding straps and/or fixing elements, with respective associated components, which are rigid parts of the machine, may also be provided within the framework of the present invention.

The present invention also pertains to a set of interchangeable sorting plates for a device according to the present invention, where the interchangeable sorting plates of a set of interchangeable sorting plates are designed for different sets of coins. This means that an interchangeable sorting plate is provided with sorting openings of the cross sections d depending on the diameters of the coins of the particular set of coins to be sorted. For example, a device used in Germany may have a set of interchangeable sorting plates comprising an interchangeable sorting plate for DM and an interchangeable sorting plate for euro. Using such a set of interchangeable sorting plates, the changeover to the other currency can be carried out rather easily and without any major installation and/or service effort especially also during the phase of transition. Therefore, the present invention also pertains to a process for converting a device according to the present invention to different sets of coins, in which case an interchangeable sorting plate for one set of coins is replaced with an interchangeable sorting plate for another set of coins.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
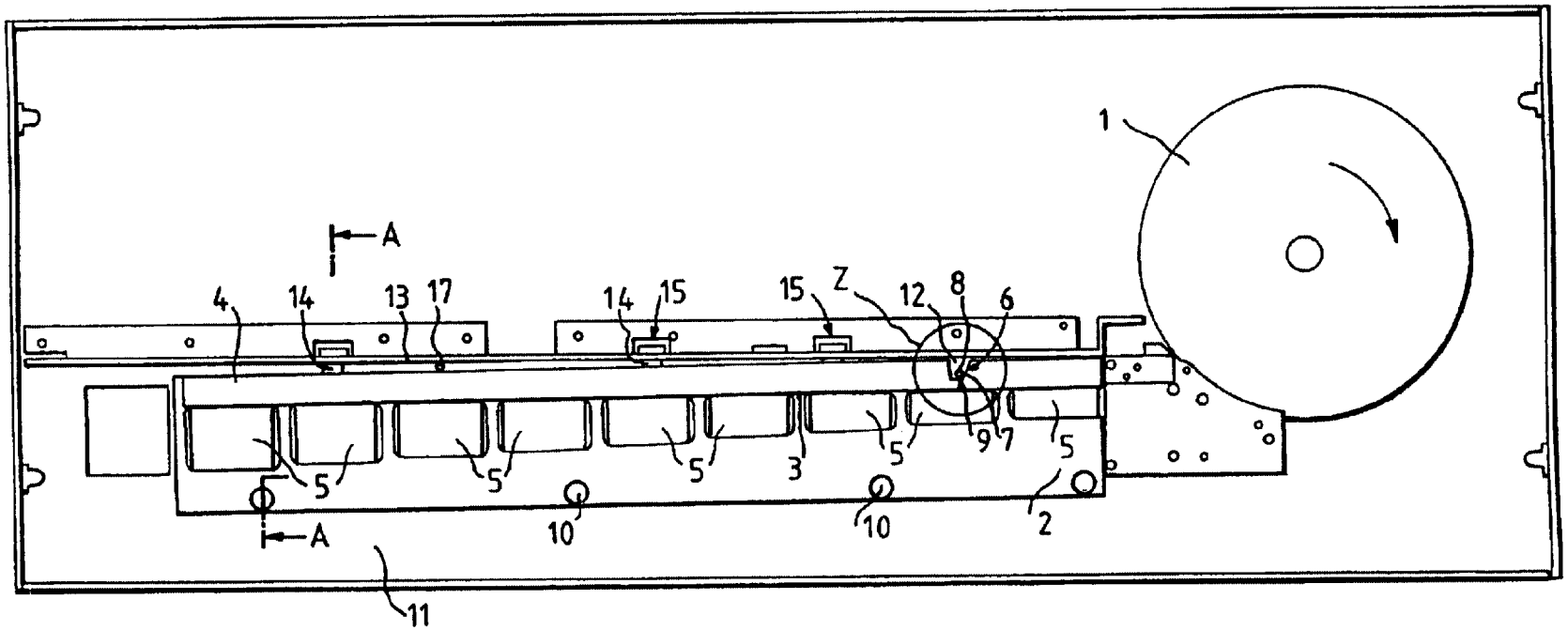
FIG. 1 is a top view of a device according to the present invention with a mounted interchangeable sorting plate.

Referring to the drawings, FIG. 1 shows a device for sorting coins of a set of coins with a coin feed device 1 designed as a rotary table, with a sorting plate 2, which joins the coin feed device 1 and has a guide edge 3 as well as a guide strip 4 extending along the guide edge 3. It can also be recognized that a series of sorting openings 5 graduated for different coin diameters with cross sections increasing in the direction of conveying are provided within the framework of the sorting plate 2. In the view shown in FIG. 1, the direction of conveying extends from right to left. It is not shown in FIG. 1 that a circulating conveyor belt, which conveys coins fed in and separated on the sorting plate from the coin feed device 1, with the coins running along the guide edge, is provided during the operation above the plane of the drawing. When a coin being conveyed which has a diameter smaller than the width q of a sorting opening 5 plus the width d of the guide strip 4 reaches the corresponding sorting opening 5, it is no longer supported on the side opposite the guide strip 4 and falls through the sorting opening 5 into an associated collection vessel.

Figure 2:
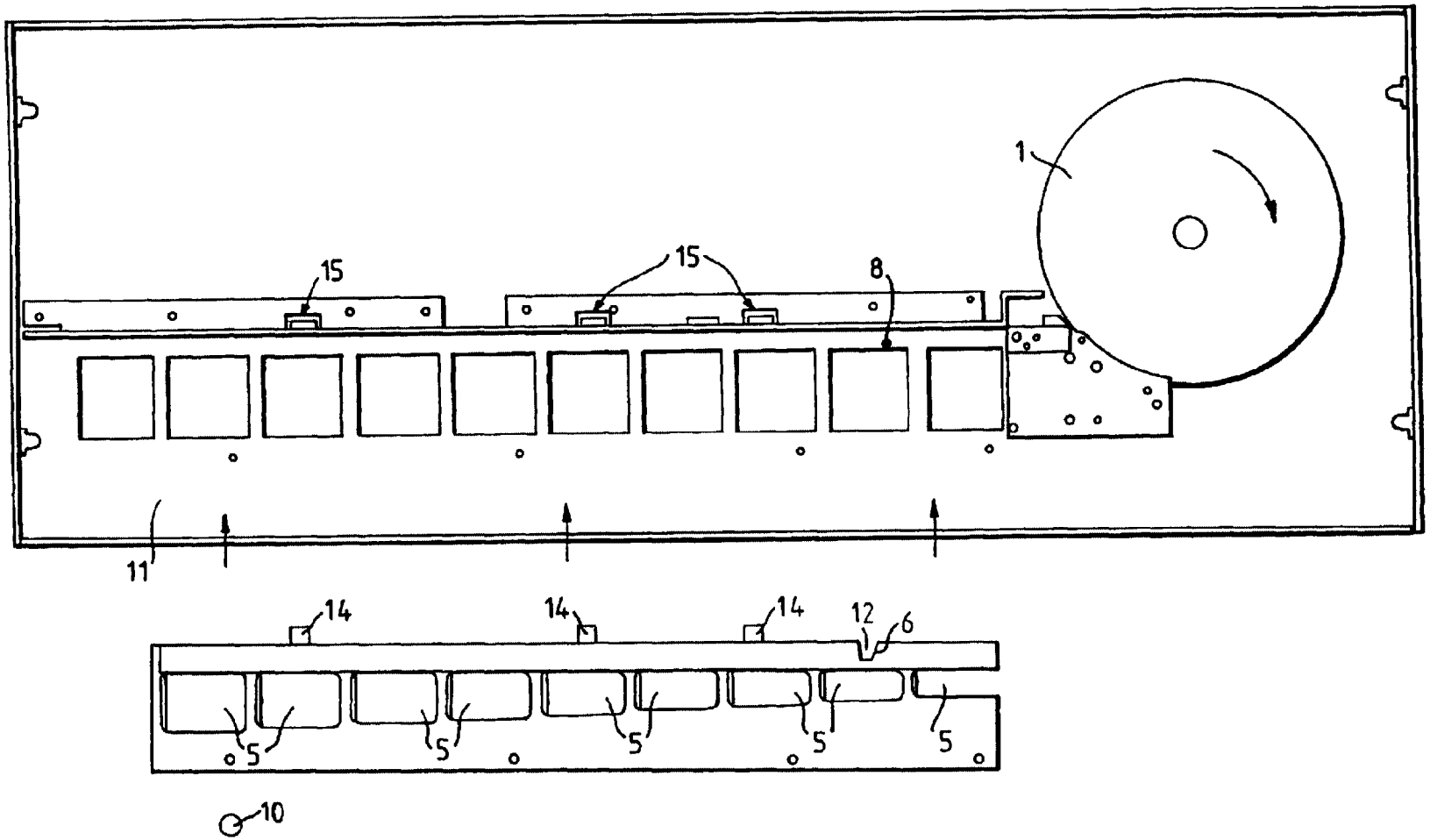
FIG. 2 is a view of the object according to FIG. 1 but with the interchangeable sorting plate removed.
Figure 3:
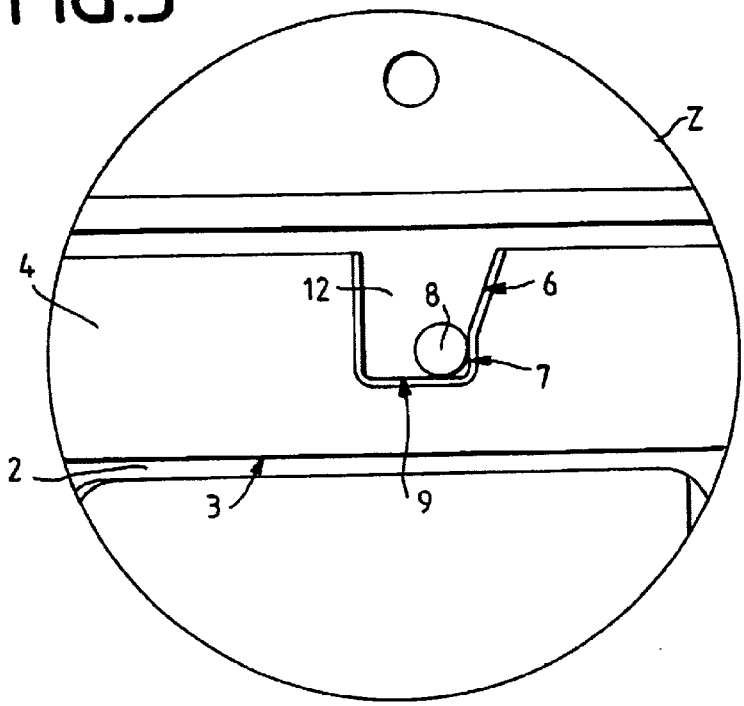
FIG. 3 is a detail view of a mounted interchangeable sorting plate in the area of an adjusting surface.

A comparative examination of FIGS. 1 and 2 shows that the coin sorting plate 2 is designed as an interchangeable sorting plate 2. The interchangeable sorting plate 2 can be pushed in easily in the direction of the arrow and fixed by means of the fixing element 10 designed as thumbscrews. The removal is performed in an equally simple manner in the opposite direction. A comparative examination especially of FIGS. 2 and 3 shows that the interchangeable sorting plate 2 has an adjusting surface 6 as well as a partial rest surface or stop element 7, wherein the interchangeable sorting plate 2 can be inserted in the course of this insertion into the device by means of an adjusting element 8 which interacts with the adjusting surface 6 and is a rigid part of the machine. As can be recognized especially from FIG. 3, the adjusting surface 6 is bent at an angle in relation to the longitudinal extension of the interchangeable sorting plate 2. The adjusting surface 6 is specifically arranged in a recess 12 of the interchangeable sorting plate 2, and where the recess 12 is open on one side. The adjusting element 8, which is a rigid part of the machine, is designed as a pin 8, which engages the recess 12 (see FIG. 3).

Figure 4:
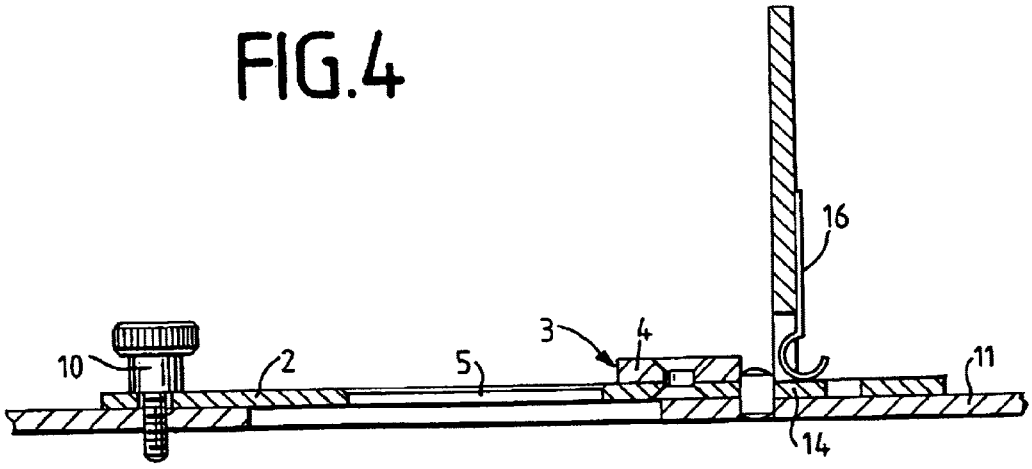
FIG. 4 is a cross sectional view through the object according to FIG. 1 along the section line A—A.

As can be seen especially in FIG. 2, the interchangeable sorting plate 2 has, at an edge extending in the longitudinal extension, a plurality of laterally projecting holding straps 14, which can be introduced into corresponding holding recesses 15 which are rigid parts of the machine. This additionally becomes particularly clear from FIG. 4. FIG. 4 also shows that the holding strap 14 can be pressed in the holding recess 15 against the carrier plate 11 by means of a retaining spring 16 in a non-positive manner. FIG. 4 as well as a comparison with FIG. 1 show that the holding straps 14 and the fixing elements 10 are arranged opposite one another with an offset in relation to the transverse extension of the interchangeable sorting plate 2.

FIG. 1 also shows that at least one stop element, which is a rigid part of the machine, e.g., a stop pin 17, may be provided for the edge 13.

Only one adjusting surface 6 is provided in the exemplary embodiment for reasons of simple design, and "clearance" is provided for the pin 8 in the area of the partial rest surface 7. The installation in FIG. 2 is now performed such that an operator positions the interchangeable sorting plate 2 such that the adjusting surface 6 and the pin 8 touch each other at the inlet of the recess 12. Then, by applying a weak force component in the direction of the longitudinal extension of the interchangeable sorting plate 2, the interchangeable sorting plate 2 is pushed in, and the adjusting surface 6 moves along the pin 8. This happens until the pin 8 comes into contact with the bottom 9 of the recess 12 in the area of the partial rest area 7. At the same time, the interchangeable sorting plate 2 with the edge 13 moves against the stop pin 17 and the holding straps 14 engage the holding recesses 15 at the same time.

As was shown above on the basis of the exemplary embodiment, the adjusting element 8 can function, in a very general manner, as a stop element at the same time. It is recommended that two stop elements be provided, in general, because it is in this case only that a static definition can be achieved in the direction of installation.

Figure 5:
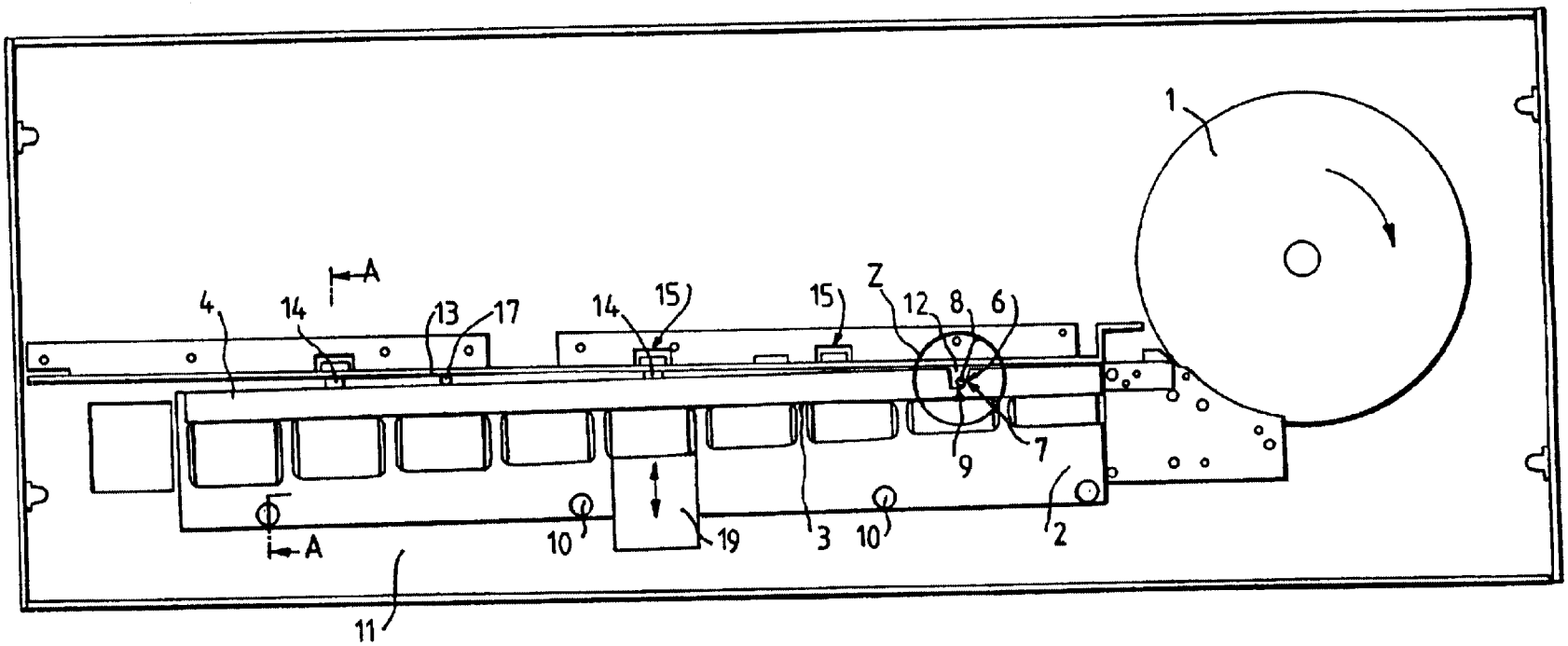
FIG. 5 is a detailed view of the embodiment in an exemplary view corresponding to FIG. 1.
Figure 6:
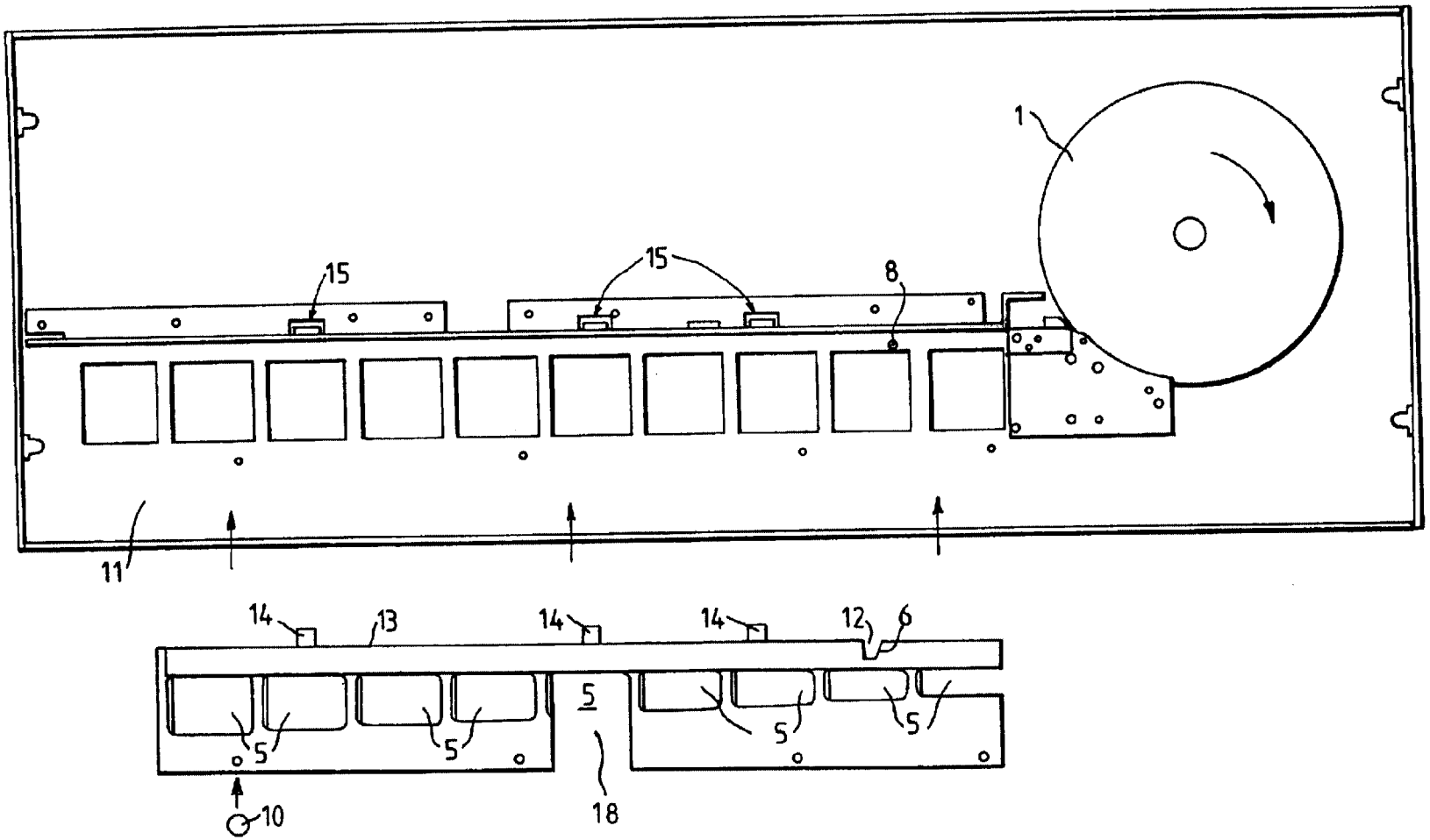
FIG. 6 is a detailed vie of the embodiment in an exemplary view corresponding to FIG. 2.

Independently from the specific exemplary embodiment shown in FIGS. 1 through 4, the following variant, indicated schematically in FIGS. 5 and 6, may be provided within the framework of the present invention. This variant may also be provided in a corresponding manner in embodiments other than that shown in FIGS. 1 through 4. According to this variant, the interchangeable sorting plate 2 may have a slide recess 18, which corresponds to a slide 19 (for the direction of displacement, see arrow) mounted displaceably at the carrier plate 11. With the interchangeable sorting plate 2 installed, the slide 19 slides to and fro within the slide recess 18. At any rate, the part of the slide 19 facing the guide edge 3 is flush at the top side: with the top side of the guideway of the interchangeable sorting plate 2, so that no steps are formed for the coins being conveyed on the built-in interchangeable sorting plate 2 in the direction of conveying. The function of a slide is explained as follows. If the slide 19 and the slide recess 18 are provided, e.g., within the framework of the sorting opening that is the first sorting opening in the direction of conveying, e.g., a so-called check counting may take place. The slide 19 is now extended from a sorting position, in which it forms a sorting opening 5 for, e.g., the smallest coin of a set of coins within the slide recess 18, into a check position, in which all coins of the set of coins pass through the now larger sorting opening 5 and fall off. The total number of all the coins to be counted is then counted, regardless of their diameter. It is also possible to provide a plurality of slides 19 and slide recesses 18. The purpose of this is to collect coins of equal size in different collection containers under the sorting openings 5. It is thus possible to change over from a full collection container to an empty collection container for coins of equal diameter with only a very short interruption in time. The arrangement is specifically such that sorting openings 5 with slide recesses 18 in the direction of conveying are arranged in front of "normal" sorting openings 5. In its normal position, the slide 19 forms a sorting opening 5 of equal cross section as the "normal" sorting opening 5, with the result that all coins of a corresponding diameter fall through the sorting opening formed with the slide 19. When the associated collection container is full, the slide 19 is withdrawn into a locked position, in which the coins in question slide over the now smaller or completely closed sorting opening 5. These coins will then reach the "normal" sorting opening 5 and then fall into a second collection container associated with the same coin diameter. The collection container associated with the sorting opening 5 reduced in terms of the slide can be changed with an empty one without a hurry, without an appreciable interruption in the sorting operation. A corresponding procedure is performed when the changeover has been performed, at the latest when the downstream collection container is full.

While specific embodiments of the invention have been shown and described in detail to illustrate the application of the principles of the invention, it will be understood that the invention may be embodied otherwise without departing from such principles.

What is claimed is:

1. A device for sorting a plurality of coins, the device comprising:

a coin feed device;

a sorting plate joining said coin feed device, said sorting plate includes a guide edge and a guide strip extending along said guide edge, said sorting plate defining a series of sorting openings grated for different coin diameters with cross sections increasing in a direction of conveying, said sorting plate being designed as an interchangeable sorting plate, said interchangeable sorting plate having at least one adjusting surface and at least one stop element, wherein said interchangeable sorting plate can be pressed against a stop which is a rigid part of the device by means of an adjusting element, which interacts with said adjusting surface and is a rigid part of the device said stop element, during insertion of said interchangeable sorting plate into the device.

2. A device in accordance with claim 1, wherein:

said interchangeable sorting plate defines a slide recess.

3. A device in accordance with claim 1, further comprising:

a plurality of said interchangeable sorting plates, each of said interchangeable sorting plates being designed for different sets of coins.

4. A device in accordance with claim 1, wherein:

said interchangeable sorting plate has at least one fixing element for fixing an inserted said interchangeable sorting plate on a carrier plate.

5. A device in accordance with claim 4, wherein:

said fixing element is a thumbscrew.

6. A device in accordance with claim 1, wherein:

said adjusting surface is bent at an angle in relation to a longitudinal extension of said interchangeable sorting plate and said stop element is arranged at an end of said interchangeable sorting plate.

7. A device in accordance with claim 1, wherein:

said adjusting surface is arranged in a recess of said interchangeable sorting plate, and that said adjusting element, which is a rigid part of the machine, is designed as a pin engaging said recess.

8. A device in accordance with claim 1, wherein:

said interchangeable sorting plate has an edge extending in a longitudinal direction, said edge includes at least one laterally projecting holding strap which can be introduced into a holding recess which is a rigid part of the device.

9. A device in accordance with claim 8, wherein:

said holding strap can be pressed in said holding recess against a carrier plate in a non-positive manner.

10. A device in accordance with claim 9, wherein:

said holding strap is pressed by a retaining spring.

11. A device in accordance with claim 8, wherein:

said interchangeable sorting plate has at least one fixing element for fixing an inserted said interchangeable sorting plate on a carrier plate;

said holding strap and said fixing element are arranged opposite one another directly or with an offset relative to a transverse extension of the said interchangeable sorting plate.

12. A device for sorting a plurality of coins, the device comprising:

a carrier plate defining a plurality of carrier openings and including an adjusting element:

a coin feed device arranged at said carrier plate;

a sorting plate arranged on said carrier plate and joining said coin feed device, said sorting plate includes a guide edge and a guide strip extending along said guide edge, said sorting plate defining a series of sorting opens graduated for different coin diameters with cross sections increasing in a direction of conveying, said sorting plate movable with respect to said carrier plate between a fixed position and a removed position, said fixed position holding said sorting plate fixed to said carrier plate with said sorting openings aligning with said carrier openings, said removed position separating said sorting plate from said carrier plate, said sorting plate defining a recess receivable of said adjusting element, said recess including a adjusting surface and a stop, said sorting plate being positionable on said carrier plate to have said adjusting element in contact with said stop of said sorting plate, said adjusting element and said stop of said sorting plate being arranged to specifically position said sorting plate on said sorting plate on said carrier plate.

13. A device in accordance with claim 12, further comprising:

another sorting plate interchangeable with said sorting plate on said carrier plate.

14. A device in accordance with claim 13, wherein:

sorting openings of said another sorting plate are different in size from said sorting openings of said sorting plate.

15. A device for sorting a plurality of coins, the device comprising:

a coin feed device;

a sorting plate joining said coin feed device, said sorting plate includes a guide edge and a guide strip extending along said guide edge, said sorting plate defining a series of sorting openings graduated for different coin diameters with cross sections increasing in a direction of conveying, said sorting plate being designed as an interchangeable sorting plate, said interchangeable sorting plate having an edge extending in a longitudinal direction, said edge includes at least one laterally projecting holding strap which can be introduced into a holding recess which is a rigid part of the device, said holding strap is pressable in said holding recess against a carrier plate in a non-positive manner, said holding strap is pressed by a retaining spring.

* * * * *